United States Patent [19]

McDaniel et al.

[11] 4,037,976

[45] July 26, 1977

[54] WRITING NIB STRUCTURE AND METHOD OF MANUFACTURE

[75] Inventors: John E. McDaniel, Douglasville; Harold B. Morris, Newman, both of Ga.

[73] Assignee: Glasrock Products, Inc., Fairburn, Ga.

[21] Appl. No.: 663,220

[22] Filed: Mar. 2, 1976

Related U.S. Application Data

[62] Division of Ser. No. 586,593, June 13, 1975, abandoned.

[51] Int. Cl.[2] ..... B43K 1/00

[52] U.S. Cl. ..... 401/198; 156/153; 156/244; 264/139; 264/162; 264/163; 264/171; 264/321; 264/345; 401/265; 428/307; 428/315

[58] Field of Search ..... 264/327, 345, 171, 162, 264/138, 163, 139; 401/198, 199, 265; 131/265; 156/244, 153; 428/307, 315

[56] References Cited

U.S. PATENT DOCUMENTS

| | | | |
|---|---|---|---|
| 2,994,110 | 8/1961 | Hardy | 264/171 |
| 3,094,736 | 6/1963 | Bunzl et al. | 401/198 |
| 3,111,702 | 11/1963 | Berger | 401/199 |
| 3,449,054 | 6/1969 | Lundsager | 401/198 |
| 3,558,392 | 1/1971 | Goodenow et al. | 401/198 |
| 3,714,314 | 1/1973 | Davidson | 264/162 |
| 3,864,183 | 2/1975 | Hori | 401/198 |
| 3,957,940 | 5/1976 | Schubert et al. | 264/171 |

*Primary Examiner*—Edward G. Whitby
*Attorney, Agent, or Firm*—Lane, Aitken, Dunner & Ziems

[57] ABSTRACT

A writing nib for pens and marking implements having an elongated body of generally rectangular configuration and reinforced by layers of relatively rigid solid material laminated to opposite surfaces of a relatively soft wicking material. The nib is formed by continuously forming layers of the relatively rigid material on opposite surfaces of a strip of wicking material, shaping both edges of the laminated strip and severing the laminated strip transversely, the shaped edges of the laminated strip ultimately forming a writing tip at each end of the nib body at which the wicking material projects beyond the corresponding ends of the rigid material.

11 Claims, 7 Drawing Figures

WRITING NIB STRUCTURE AND METHOD OF MANUFACTURE

CROSS-REFERENCE TO RELATED APPLICATION

This is a division of application Ser. No. 586,593 filed June 13, 1975 now abandoned.

BACKGROUND OF THE INVENTION

This invention relates to nibs for writing implements and more particularly, it concerns a writing nib structure and method of manufacture.

Commonly used felt tip pens and marking implements employ a nib by which ink or other marking fluid contained in a reservoir within the implement is fed by capillary action along the length of the nib to its projecting tip in contact with a writing surface. The popularity of such implements both as writing pens and as markers is perhaps attributable in substantial measure to such desirable characteristics as adaptability to a wide variety of writing surfaces, smoothness with which the pen tip or nib glides on a writing surface and continuity of ink or marking fluid flow through the nib onto a writing surface. A principal shortcoming of such felt tip pens and marking implements, however, is the deterioration with use of the writing nib tip to a degree that a clear line of uniform thickness becomes difficult to write, often before the supply of ink in the pen or implement is exhausted. As a result of this shortcoming, many materials and pen nib constructions have been developed out of efforts to achieve or retain the aforementioned desirable characteristics while at the same time strengthen or ridigify the pen nib to increase its useful life. Although much progress has been made in the development of stronger more rigid materials for writing pen nibs, the use of stronger nib materials involves a compromise between durability and writing smoothness. In other words, writing smoothness in increased with nib material softness whereas nib life is increased with harder and more rigid materials which have a tendency to scratch many writing surfaces.

An effective approach to the achievement of both strength and writing smoothness in a pen nib is exemplified by the disclosures of such U.S. Pat. Nos. as 3,094,736 issued June 25, 1963 to R. H. Bunzl et al, 3,167,803 issued Feb. 2, 1965 to Shigeki Shimamura, 3,213,025 issued Aug. 31, 1965 to C. Schreur and 3,464,775 issued Sept. 2,1969 to K. F. Beal. The pen nib structures shown in these patents are generally characterized as having a relatively soft wicking core enclosed in a reinforcing sheath of relatively strong solid material. The nibs are usually fromed by providing an elongated strand of the sheathed core element which is cut to the length of the individual nib and machined or otherwise treated on one end of the nib to leave the soft core projecting slightly from the corresponding end of the sheath as a writing tip.

Although the combination of nib strength and writing smoothness achievable by the aforementioned sheathed or reinforced nibs is highly desirable, the manufacturing costs associated with their manufacture in quantity are high principally because of the requirement for forming a writing tip on each individual nib. While such costs may fall within tolerable limits where the writing tip end of each nib is a surface of revolution, such as conical or hemispherical, they are increased to unjustified levels for noncircular nibs of the type used, for example, in wide-line writers or marking implement nibs.

SUMMARY OF THE PRESENT INVENTION

In accordance with the present invention, a writing nib having improved writing and strength properties is provided by forming a laminated strip in which a continuous layer of wicking material is sandwiched between layers of relatively rigid, high strength material, shaping the edges of the laminated strip such that the wicking material projects beyond the layers of the relatively rigid material on at least one edge and severing the strip transversely at longitudinal increments corresponding to the desired width of the wiring nib to be formed, thereby to provide a writing nib having an elongated body of generally rectangular cross-sectional configuration in which the thickness or dimension transverse to the width of the body is the same as the laminated sheet from which the nibs are severed. It is preferred that both edges of the laminated strip be machined or otherwise formed so that the nib cut transversely therefrom is double ended; that is, formed so that the central layer of wicking material projects at both ends of the nib as a writing tip. As a consequence of this, the resulting nib may be assembled in a writing or marking implement without first requiring lengthwise orientation of the nib to leave only the writing tip of the nib projecting from the implement. Additionally, it is preferred that the severance of individual nibs from the laminated strip be at an angle with respect to the length of the strip and correspondingly with respect to the formed side edges thereof so that the writing tip in the nib ultimately incorporated in a pen or marking implement will be disposed at a comfortable or normal writing angle.

The laminated strip may be formed in different ways depending on the particular wicking material to be employed in the nib. For example, if the wicking material is formed of porous thermoplastic material, the relatively rigid reinforcing outer layers of the strip may be formed by heating the outer layers of a preformed thermoplastic porous strip to solidify the outer surface portions thereof by heat fusion. Alternatively, the relatively rigid outer layers of the strip may be formed by coating a strip of porous wicking material with an appropriate material capable of providing the desired reinforcing characteristics upon solidifying or setting. A preferred method of coating a strip in this manner is the passage of the preformed porous wicking strip through an extrusion die by which the outer layers are deposited on opposite surfaces of the wicking material.

Although any desired writing tip configuration may be provided on the nibs formed in accordance with the present invention by appropriate selection of the means employed in the shaping of the strip edges, the nib is preferably provided with a wide-line writing tip which is essentially continuous or linear in the direction of its width and rounded or semi-cylindrical in a plane transverse to its width. A writing tip configuration of this type is easily formed by continuously machining the edges of the strip from which the nibs are cut and is also desirable during writing use to allow a normal rocking of the nib without change in the line or mark effected.

Among the objects of the present invention are: the provision of an unique writing nib for pens or marking implements as well as a novel process by which the nib may be manufactured; the provision of such an improved nib having a desirable combination of structural rigidity and writing smoothness; the provision of such a writing nib having an unique writing tip; the provision of such a writing nib for pens or marking implements by which its assembly in such a writing implement is facilitated as a result of longitudinal symmetry; and the provision of an unique method for making writing nibs of the aforementioned type by which any of numerous types of writing nib material may be used.

Other objects and further scope of applicability of the present invention will be apparent from the detailed description taken in conjunction with the accompanying drawings in which like reference numerals designate like parts.

DETAILED DESCRIPTION OF THE PREFERRED EMBODIMENTS

Figure 1:
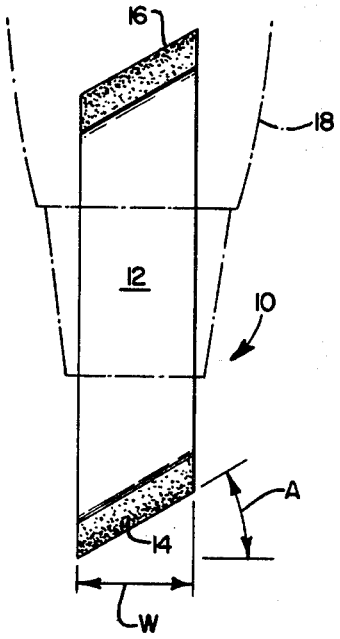
FIG. 1 is a side elevation showing the writing nib of the present invention.
Figure 2:
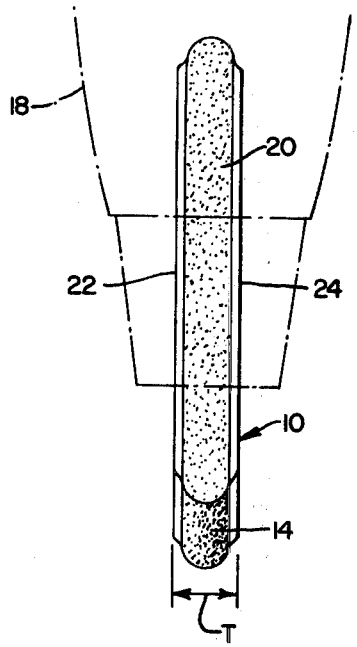
FIG. 2 is an elevation at right angles to that of FIG. 1.

In FIGS. 1 and 2 of the drawings, the improved writing nib of the present invention is generally designated by the reference numeral 10 and is established by an elongated body 12 of generally rectangular cross-sectional configuration having a width W and thickness T. A writing tip 14 is formed at one end of the body 12 and preferably disposed at an angle A with respect to a line perpendicular to the longitudinal dimension of the body. A writing fluid receiving end 16 is located at the opposite end of the body from the writing tip 14 but is identical in all structural respects to the writing tip 14. When assembled in a pen or marking implement 18, the writing end of which is partially outlined by phantom lines in FIGS. 1 and 2, the writing tip 14 will project from the writing end of the pen 18 whereas the ink receiving end 16 of the tip 10 will be in contact with a supply of ink or marking fluid contained by a reservoir (not shown) within the body of the pen or marking implement 18.

The configuration of the writing tip 14 is preferably linear in the direction established by the angle A and semi-circular in a plane normal to that linear dimension, thereby to establish a semi-cylindrical writing tip configuration. Such a configuration, when disposed at the angle A to the writing surface on which the pen 18 is used, will facilitate complete linear engagement of the tip 14 with the writing surface in normal writing practice. Although any desired angle may be selected, it is preferred that the angle A be on the order of 30°. Also because of the semi-cylindrical configuration of the tip 14, rocking movement of the pen transverse to the length of the writing tip will not effect the writing characteristics of the nib 10.

As shown most clearly in FIG. 2, the structure of the nib 10 is further characterized as having a central layer 20 of relatively soft wicking material sandwiched between a pair of relatively rigid reinforcing layers 22 and 24. Although the manner in which this laminated construction of the nib 10 is effected will be described in more detail below, it will be appreciated that because the writing tip 14 constitutes a projection of the wicking material layer beyond the corresponding ends of the reinforcing outer layers 22 and 24, the smooth writing characteristics of a relatively soft wicking material obtain from the construction of the nib 10. Moreover, superior writing nib strength is achieved as a result of the reinforcement provided by the outer relatively rigid and strong layers 22 and 24.

The operation of the nib 10 during use of the pen or marking implement 18 is conventional to the extent that ink or marking fluid supplied to the end 16 of the nib will pass by capillary action along the layer 20 to the writing tip 14. It is to be noted that from the standpoint of functioning as a writing nib in this manner, any configuration of the end 16 which will enable the passage of ink or marking fluid to the layer 20 is acceptable to effective operation of the nib 10. A significant assembly advantage is obtained, however, where the end 16 is identical in configuration to the writing tip 14. Specifically, the longitudinal symmetry or reversibility of the nib 10 permits its assembly with the pen or marking implement 18 irrespective of longitudinal orientation.

Figure 3:
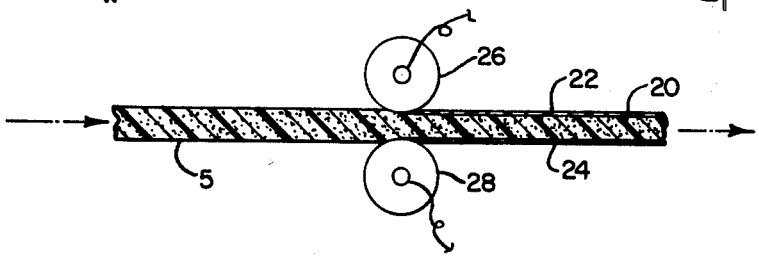
FIG. 3 is a fragmentary cross-section depicting one method of providing a laminated strip used in the formation of the nib shown in FIG. 2.
Figure 6:
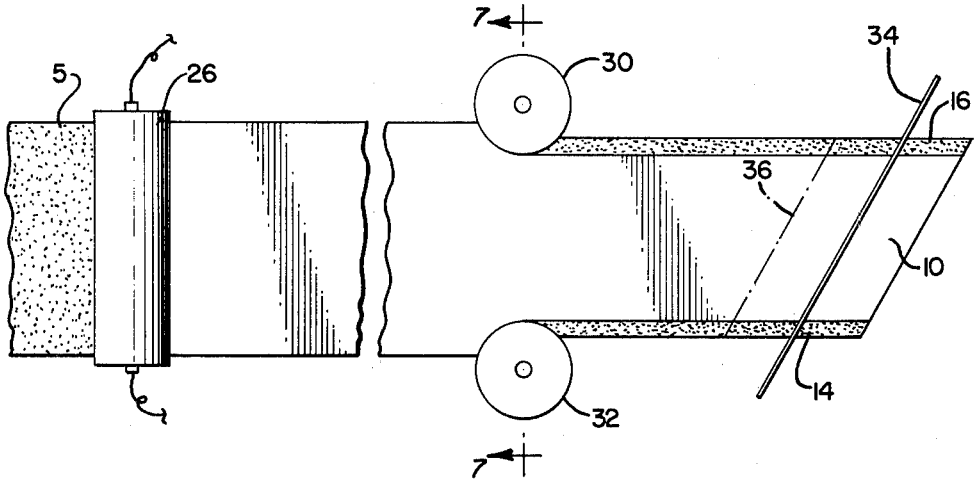
FIG. 6 is a schematic plan view illustrating the successive forming operations employed in the production of pen nibs in accordance with the present invention.
Figure 7:
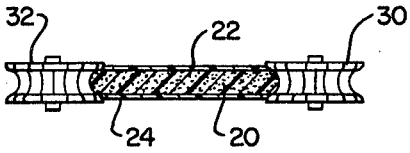
FIG. 7 is a cross-section on line 7—7 of FIG. 6.

An exemplary embodiment of a preferred method for the manufacture of the pen nib 10 may be understood by reference to FIGS. 3, 6, and 7 of the drawings. In this embodiment, it is presumed that the layer of wicking material 20 is any of many well-known porous thermoplastic materials conventionally employed in writing pen nibs. Hence, a strip S of the porous thermoplastic material is fed between a pair of heated rollers 26 and 28 to fuse the porous material on opposite sides and thus form the laminate or sandwich structure in which the wicking material 20 is sandwiched between the relatively rigid surface layers 22 and 24. After the laminate thus formed has cooled, the strip is passed between a pair of edge forming tools 30 and 32. The tools 30 and 32 may be selected from a variety of machining or abrading tools such as milling cutters as shown in FIG. 6 or coarse abrasive tools. As shown in FIG. 6, the tools 30 and 32 are of a shape to machine the semi-cylindrical configuration of the nib ends 14 and 16 as described above. The construction of the nib is completed by a knife 34 to sever the strip S at predetermined severance lines 36 extending transversely of the strip. Although the knife 34 is depicted schematically in FIG. 6 as a simple blade, it will be appreciated that high speed operation is achievable using a rotary-type cutter synchronized with longitudinal travel of the strip S. Also it will be understood that the angle at which the strip S is severed to form the nibs 10 will determine the writing angle A of the tip 10 described above with respect to FIGS. 1 and 2.

Figure 4:
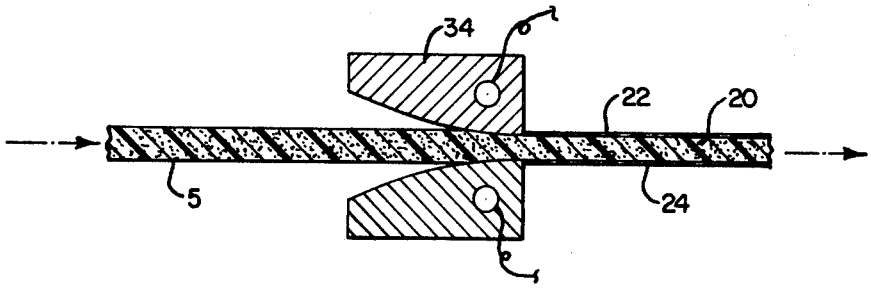
FIG. 4 is a similar cross-section view illustrating an alternative manner of forming the laminated strip shown in FIG. 3.

It is contemplated that heating devices other than the rollers 26 may be employed to form the relatively rigid layers 22 and 24 on the thermoplastic porous strip S. For example, in FIG. 4 of the drawings, the strip is passed through a heated stationary die 34. It is also contemplated that the combination of a heated roller and stationary die (not shown) might be employed.

Figure 5:
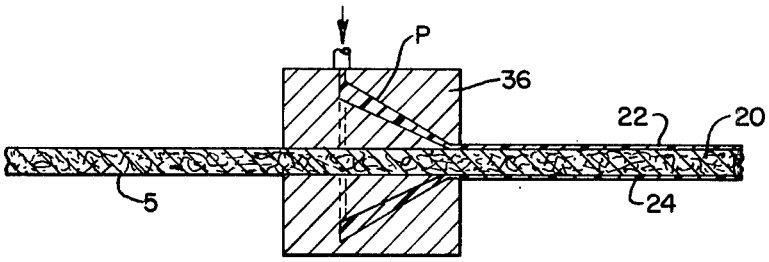
FIG. 5 is a cross-section similar to FIGS. 3 and 4 but illustrating still a further alternate embodiment of a method for forming the laminated strip from which the pen nibs of the present invention are formed.

A preferred method for achieving the sandwiched strip structure, particularly where a wicking material other than porous thermoplastic is desired, is depicted in FIG. 5 of the drawings. In this instance, the strip S is passed through an extrusion die 36 by which a plastic material P is extruded onto opposite sides of the strip to form the layers of rigid material 22 and 24. Co-extrusion of materials in this manner is well-known to the plastics art. Subsequent treatment of the strip after the layers 22 and 24 are formed will proceed as described above with respect to FIGS. 3, 6 and 7 of the drawings.

Thus it will be appreciated that by this invention there is provided an improved pen nib and method for its manufacture by which the above mentioned objectives are completely fulfilled. It is also contemplated that various modifications and/or changes may be made in the disclosed embodiments without departure from the inventive concepts manifested by those embodiments. For example, the use of the method to manufacture wide-line writing nibs is preferred because of the facility for continuously forming the edges of the strip which is cut transversely to form the nibs. It is contemplated, however, that pen nibs having other types of tips might be made using the process by substituting for the tools 30 and 32 shown in FIGS. 5 and 6 intermittently actuated forming tools operated in synchronism with the cut-off knife 34. Thus, while the process of the invention is particularly applicable to the formation of the nib structure illustrated in FIGS. 1 and 2 of the drawings, it will be appreciated that other tip formations may be provided using the process. In light of the prospective possible modifications and/or changes which might be made in the embodiments disclosed herein, it is expressly intended that the foregoing description is illustrative only, not limiting, and that the true spirit and scope of the present invention be determined by reference to the appended claims.

We claim:

1. The method of forming writing nibs comprising the steps of:

forming layers of relatively rigid material on opposite surfaces of a strip of wicking material thereby to provide a laminated strip in which said wicking material extends between and is exposed on opposite edges of said laminated strip;

shaping at least one edge of said laminated strip so that said wicking material projects beyond said layers of relatively rigid material at said edge; and severing said laminated strip transversely at longitudinal increments to provide writing nibs of a length corresponding to the transverse dimension of said laminated strip.

2. The method recited in claim 1 in which said layers of relatively rigid material are deposited onto opposite sides of said strip of wicking material.

3. The method recited in claim 2 in which said layers of relatively rigid material are deposited by extrusion during longitudinal movement of said wicking material strip.

4. The method recited in claim 1 in which said strip of wicking material is a porous thermoplastic, said relatively rigid layers being formed by fusion of opposite surface portions of said strip.

5. The method recited in claim 1 in which both edges of said laminated strip are shaped so that said wicking material projects beyond said layers of relatively rigid material at both edges of said laminated strip.

6. The method recited in claim 1 in which said edge is continuously shaped during longitudinal movement of said laminated strip thereby to establish a shaped edge of uniform linear configuration.

7. The method recited in claim 6 in which said edge is shaped to a semi-cylindrical configuration.

8. The method recited in claim 1 in which both edges of said laminated strip are continuously shaped during longitudinal movement thereof to provide a uniform linear configuration at each edge and wherein said severing step is also performed in synchronism with longitudinal movement of said laminated strip.

9. The method recited in claim 8 wherein said laminated strip is severed transversely at an angle to the longitudinal dimension thereof.

10. The method recited in claim 9 wherein said laminated strip is severed at an angle of approximately 30° to the longitudinal dimension thereof.

11. The writing nib product formed by the method of claim 10.

* * * * *